US006520875B1

(12) United States Patent
Crawford

(10) Patent No.: US 6,520,875 B1
(45) Date of Patent: Feb. 18, 2003

(54) CHANNELED MESH WEBBING POCKET ASSEMBLY FOR A LACROSSE STICK

(75) Inventor: William C. Crawford, Baltimore, MD (US)

(73) Assignee: STX LLC, Baltimore, MD (US)

( * ) Notice: Subject to any disclaimer, the term of this patent is extended or adjusted under 35 U.S.C. 154(b) by 0 days.

(21) Appl. No.: 09/696,761

(22) Filed: Oct. 26, 2000

(51) Int. Cl.[7] ..... A63B 59/02; A63B 65/12
(52) U.S. Cl. ..... 473/513
(58) Field of Search ..... 473/512, 513, 473/514

(56) References Cited

U.S. PATENT DOCUMENTS

| | | | |
|---|---|---|---|
| 2,992,550 | A | 7/1961 | Frith, Jr. |
| 3,171,272 | A | 3/1965 | Frith, Jr. |
| 3,822,062 | A | 7/1974 | Tucker et al. |
| 3,905,088 | A | 9/1975 | Tucker et al. |
| 4,049,273 | A | 9/1977 | Pool |
| 4,153,251 | A | 5/1979 | Pond |
| 4,938,480 | A | 7/1990 | Lods |

OTHER PUBLICATIONS

*Ulman Lacrosse Catalog*, p. 7 (1990).

*Primary Examiner*—Paul T. Sewell
*Assistant Examiner*—M. Chambers
(74) *Attorney, Agent, or Firm*—Connolly Bove Lodge & Hutz LLP

(57) ABSTRACT

An expandable mesh web for use with a lacrosse stick head. The head includes a frame member having first and second side walls, each side wall having a proximal end and a distal end. The frame member further has a scoop extending between the distal ends of the side walls, and a stop extending between the proximal ends of the side walls. The expandable mesh web is attached to the frame member, and includes at least two ball channel walls that extend longitudinally along the length off the frame member and are generally thicker and more dense than the rest of the expandable mesh web.

20 Claims, 2 Drawing Sheets

CHANNELED MESH WEBBING POCKET ASSEMBLY FOR A LACROSSE STICK

BACKGROUND OF THE INVENTION

A. Field of the Invention

The present invention relates generally to lacrosse sticks, and, more particularly, to a channeled mesh webbing pocket assembly for a lacrosse stick.

B. Description of the Related Art

As shown in FIG. 1A, a traditional lacrosse stick stringing assembly configuration 10 usually comprises four longitudinal leather thong elements 12 which extend between respective apertures 22 defined in the part of a head of a lacrosse stick known as the scoop 16, and the base of the head adjacent to the part of a lacrosse head known as the stop 23. Each leather thong element 12 comprises one or more vertical slits 20 for attaching leather thong element 12 in an aperture 22 provided in scoop 16 of the head. An open weave cross lacing 14 extends transversely to interconnect leather thong elements 12 to the head frame and maintain the same in a predetermined space relation. Open weave cross lacing 14 wraps around leather thong elements 12 in certain sections, but may also extend through vertical slits provided in leather thong elements 12. The overall assembly thus forms what is referred to as a traditionally strung pocket for catching, carrying and throwing the lacrosse ball.

Another lacrosse stick stringing configuration known in the art is the mesh configuration. Rather than the longitudinal thongs and open weave lacing of the traditional lacrosse stick stringing configuration, the mesh configuration employs a mesh knitted as a continuous, uniform design of woven material (see FIG. 1B) having a plurality of openings or "mesh diamonds" provided therein. The mesh diamonds are "uniform" since the diamonds all have the same size. The mesh is peripherally coupled to the head of the lacrosse stick by a single or multiple stringing cords or other binding materials. Still another conventional stringing configuration 30, as shown in FIG. 1B, includes a central mesh portion 32 and open weave lacing 34 interconnecting mesh portion 32 to side walls 38 of the head frame.

In all conventional stringing configurations, transverse lacing 26 (in FIG. 1A), 36 (in FIG. 1B), also known as "throwstrings" or "shooting strings," is further provided adjacent the scoop of the lacrosse stick head, and is interwoven among the pocket lacing and leather thongs or in between the mesh diamonds. In addition to supporting the pocket stringing, the shooting strings prevent the thrown ball from traveling too far up the pocket assembly and striking the scoop area of the head. A ball striking the scoop area causes inaccurate passing and shooting of the ball. Thus, shooting strings are intended to be the point of departure of a thrown ball, facilitating accurate passing and shooting. Players use one or more shooting strings in a variety of locations and positions in the pocket in an effort to fine-tune and adjust their pocket to suit their style of play regarding catching, cradling and throwing the ball.

Inclusion of shooting strings and thong elements in a lacrosse stick stringing configuration is time consuming and subject to varying installation methods. Furthermore, traditional shooting string and thong element materials rot, break, crack, wear out, absorb water, and stretch due to weather conditions and the constant wear and tear of catching and throwing a lacrosse ball. In addition, traditional shooting strings and longitudinal thong elements are not easy to adjust since they require loosening of knots made to hold them in place and a tedious adjustment process along the parts of the shooting string and thong that are interwoven among the pocket lacing or mesh diamonds.

Thus, there exists a need in the art to provide a lacrosse stick stringing configuration that offers, by way of its design and manufacture, a mesh lacrosse pocket which incorporates a built-in tracking channel for the lacrosse ball that is a part of the completed one-piece mesh pocket unit and therefore, does not require the addition of separate materials. Such one-piece mesh pocket units would allow for faster, less expensive pocket stringing assemblies as well as more consistent ball handling results for players.

SUMMARY OF THE INVENTION

In accordance with the purpose of the invention, as embodied and broadly described herein, the invention comprises a head for a lacrosse stick, comprising: a frame member having first and second side walls, each of the side walls having a proximal end and a distal end, the frame member further having a scoop extending between the distal ends of the side walls, and a stop extending between the proximal ends of the side walls; and an expandable mesh web for receiving the ball, the expandable mesh web being attached to the frame member and having at least two ball channel walls of varying width that extend substantially longitudinally along the length of the frame member and are generally thicker and more dense than the rest of the expandable mesh web. The base channel walls may be made from the same or different material or grade of material than the rest of the expandable mesh web.

Further in accordance with the purpose of the present invention, as embodied and broadly described herein, the invention comprises an expandable mesh web for use with a lacrosse stick head comprising a frame member having first and second side walls, each of the side walls having a proximal end and a distal end, the frame member further having a scoop extending between the distal ends of the side walls, and a stop extending between the proximal ends of the side walls, the expandable mesh web comprising: a portion attached to the frame member; and at least two ball channel walls of varying width that extend substantially longitudinally along the length of the frame member and are generally thicker and more dense than the rest of the expandable mesh web. The base channel walls may be made from the same or different material or grade of material than the rest of the expandable mesh web.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENT

Figure 1A:
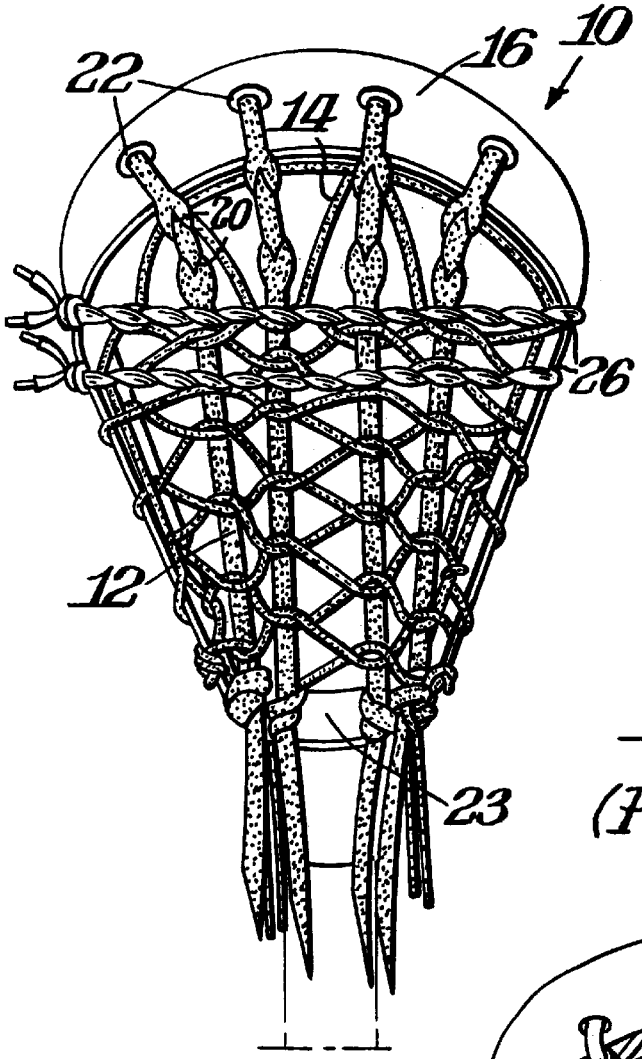
Fig. 1A. (Prior Art)
FIG. 1A is a front elevational view of a lacrosse stick head having conventional shooting string elements, conventional thong elements, and a conventional open weave cross lacing.
Figure 1B:
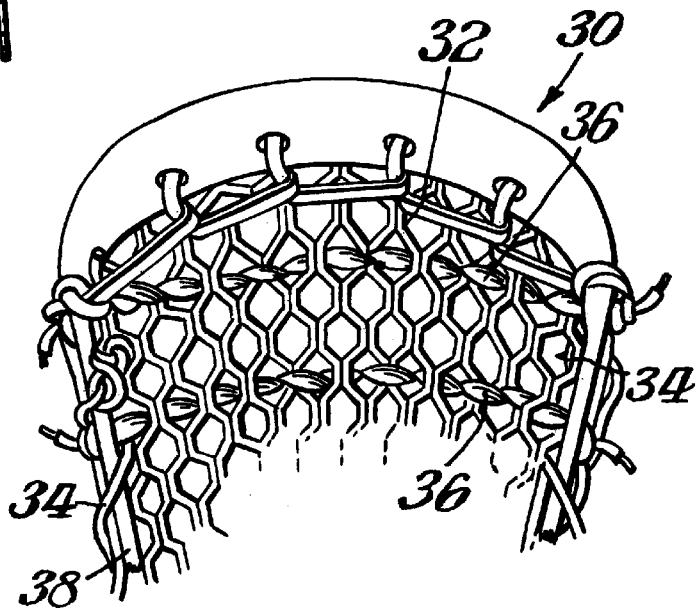
Fig. 1B. (Prior Art)
FIG. 1B is a fragmental top plan view of a lacrosse stick head having a conventional mesh web configuration and conventional shooting string elements.

Reference will now be made in detail to the present preferred embodiment of the invention, an example of which is illustrated in the accompanying drawing. Wherever possible, the same reference numbers will be used throughout the drawing to refer to the same or like parts.

As used herein, the term "sidestrings" means the material that attaches a lacrosse stringing assembly to the sidewalls of the lacrosse stick head. Sidestrings typically are made from a string-like nylon material that ties the stringing assembly to the sidewalls.

In accordance with the invention, the present invention is drawn generally to a head for a lacrosse stick. The head preferably includes a frame member having first and second side walls, each of the side walls having a proximal end and a distal end. The frame member further includes a transverse wall or scoop extending between the distal ends of the side walls, and an end wall or a stop extending between the proximal ends of the side walls. The head further includes an expandable mesh web for receiving the ball, the expandable mesh web being attached to the frame member and having a plurality of openings provided therein. The expandable mesh web also has at least two ball channel walls that extend longitudinally along the length of the frame member and are generally thicker and more dense than the rest of the expandable mesh web. The ball channel walls may be made from the same or different material or grade of material than the rest of the expandable mesh web.

Figure 2:
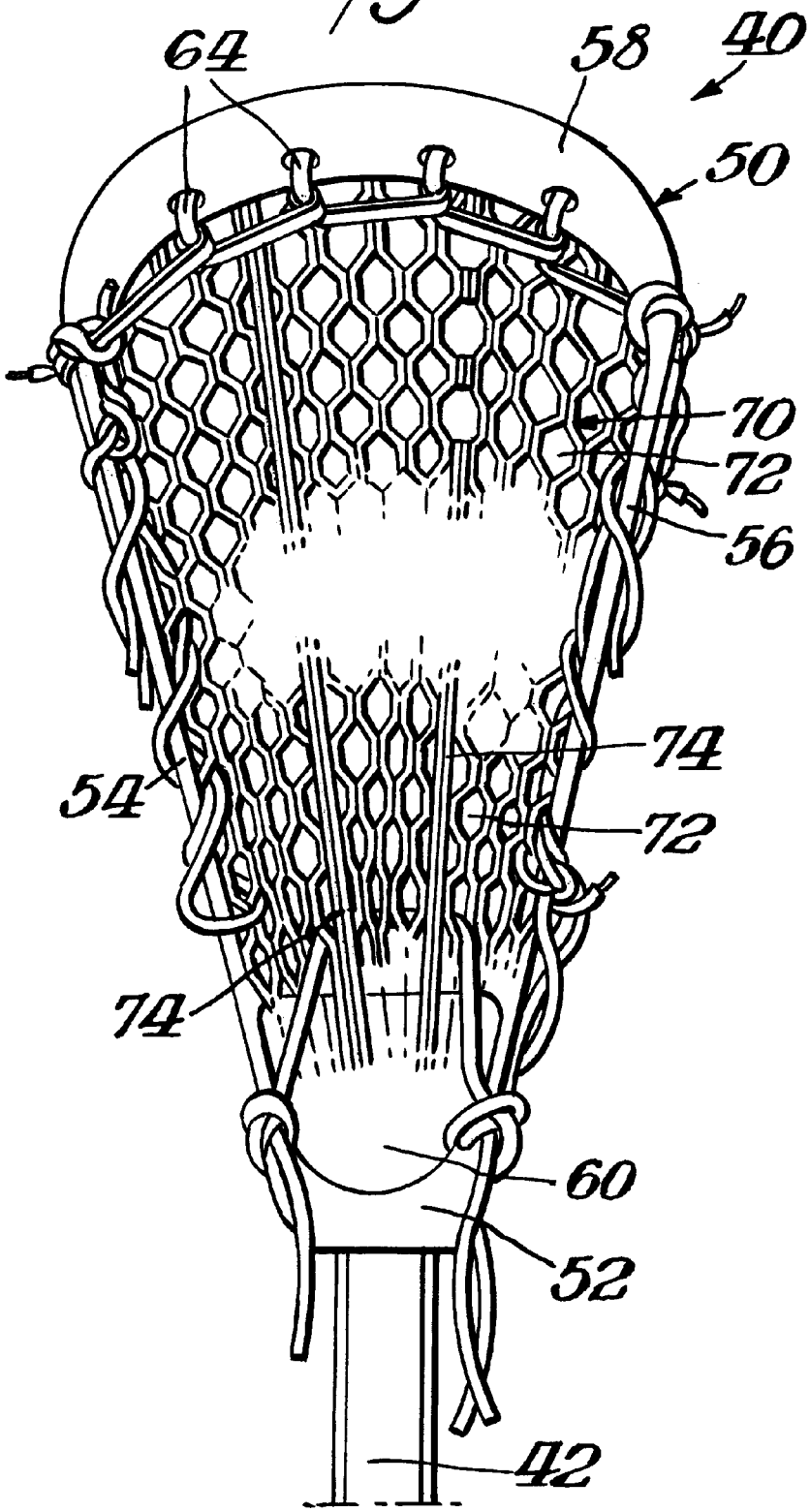
FIG. 2 is a front elevational view of a lacrosse stick head having a channeled mesh web configuration in accordance with a preferred embodiment of the present invention.

More particularly, as embodied herein and as shown in FIG. 2, a lacrosse stick 40 comprises a handle 42 shown in phantom lines and broken away, and a synthetic head 50. Head 50 comprises an integral, generally V-shaped frame member having a juncture 52, sidewalls 54 and 56 that diverge from juncture 52, a transverse wall or scoop 58 joining sidewalls 54, 56 at a distal end of head 50, and an end wall or a stop 60 joining sidewalls 54, 56 at a proximal end of head 50. Handle 42 fits into and through juncture 52 and abuts stop 60. Preferably, a plurality of string holes 62 are formed in sidewalls 54, 56, and a plurality of string holes 64 are formed in scoop 58. Stop 60 also preferably has a plurality of string holes provided therein.

In accordance with the preferred embodiment of the present invention, lacrosse stick 40 further includes a stringing assembly configuration made of an expandable mesh web 70 that extends transversely between side walls 54, 56 of the frame member of head 50 and being coupled directly to the frame member of head 50 or via sidestrings. Expandable mesh web 70 is made from a mesh knitted as a continuous strip of woven material having a plurality of interstices or openings 72 provided therein. Web 70 is formed generally in accordance with that disclosed in U.S. Pat. Nos. 2,992,550 and 3,171,272, the disclosures of which are herein incorporated by reference. As disclosed in these two patents, web 70 is preferably formed of a high-strength synthetic material, particularly nylon or similar synthetic fiber, but may be made from linen, cotton, or a thread or fiber which is composed of a combination of these materials. The mesh web material is preferably water-resistant and has specified and variable stretching characteristics, eliminating the problems experienced by conventional leather thong and woven shooting string elements, such as rotting, breaking, cracking, wearing, absorbing water, and unwanted stretching. The expandable mesh web 70 also ensures a uniform pocket area.

The longitudinal length of the mesh web 70 is cut to a predetermined length. While the openings 72 at one end portion of mesh web 70 remain unexpanded, adjacent the stop 60 of head 50, the openings 72 at the opposite end portion of mesh web 70 are widely expanded to a width generally conforming to the width of the head 50, adjacent the scoop 58 of head 50. Mesh web 70 tapers in width from the unexpanded end portion to the expanded end portion, and this taper is generally in accordance with the divergence of the side walls 54, 56.

When mesh web 70 is properly bound within head 50, it is slightly longitudinally tensioned between stop 60 and scoop 58 and is generally transversely tensioned between side walls 54, 56 adjacent scoop 58. Thus, mesh web 70 is relatively tight adjacent scoop 58 so as to facilitate ball control. At the same time, the knitted mesh is upwardly arched at the upper edge thereof generally conforming to the arch of scoop 58 with the arching of the mesh web 70 gradually decreasing towards a minimum adjacent the stop 60. Any combination of tabs, tab holes, or openings provided in frame member of head 50 can be used to affix mesh web 70 to head 50.

Notwithstanding the initial rectangular outline of mesh web 70 and the V-shaped outline of head 50, the mesh web 70 fills the head 50 without wrinkling. On the other hand, because the mesh web 70 is relatively closed adjacent the stop 60 area, when a force is applied against mesh web 70 adjacent stop 60, such as by a ball entering the head 50, the mesh web 70 in the area above the stop 60 is deformed to define a ball pocket. Mesh web 70 may be sized to fit any lacrosse stick head available, including goalie heads.

As shown in FIG. 2, the plurality of openings 72 provided in mesh web 70 are diamond shaped and have a length in the longitudinal direction of about between ½ and 1½. Openings 72, however, may have varying shapes and sizes.

Web 70 preferably includes at least two mesh vertical runners or ball channel walls 74 provided substantially near the middle portion of web 70, and transversing the longitudinal length of mesh web 70. Ball channel walls 74 may be made from the same material as web 70, and can vary in thicknesses greater than the thickness of the remaining portions of web 70. When mesh web 70 is installed in the frame member of head 50, ball channel walls 74 are preferably spaced a distance apart to prevent a lacrosse ball from moving freely between the side walls 54, 56 as occurs in the conventional mesh web. Instead, the spacing of ball channel walls 74 helps direct the ball to the center of mesh web 70 from where it can be thrown and cradled by a player with more accuracy and control. Although ball channel walls 74 may be spaced apart a variety of distances, preferably ball channel walls 74 are spaced apart in the range from two inches to three inches.

Ball channel walls 74 are preferably made from the same material as mesh web 70, but may be made from a different material than mesh web 70, or a different grade of material than mesh web 70, such as, nylon 1680 or the Spectra® fiber manufactured by Allied-Signal, Inc. Ball channel walls 74 may also vary in thickness and width to suit player preferences. For example, the thickness of ball channel walls 74 may range from 1/16 inch to ¼ inch, and the width may range from ⅛ inch to ½ inch. Furthermore, although two ball channel walls 74 are shown in FIG. 2, multiple ball channel walls (e.g., three, four, etc.) may be provided in mesh web 70 of the present invention. FIG. 2 shows ball channel walls 74 extending continuously along the length of mesh web 70, however, the ball channel walls 74 may extend intermittently along the length of the mesh web 70 or only along a portion ofmesh web 70. Finally, ball channel walls 74 may have a different color than mesh web 70, providing aesthetic options for mesh web 70.

The channeled mesh web of the present invention provides a complete, one-piece unit that is ready for play and does not require separate or additional elements to create the desired channeled effect for the lacrosse stick pocket. In addition, the ball channel walls 74 of the present invention can be designed such that the outer part of the ball channel walls 74 are made from a harder or more coarse material than the inner part of the ball channel walls 74, facilitating a channel effect that direct the ball into a more resilient pocket.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A head for a lacrosse stick, comprising:

a frame member having first and second side walls, each of the side walls having a proximal end and a distal end, the frame member further having a scoop extending between the distal ends of the side walls, and a stop extending between the proximal ends of the side walls; and an expandable mesh web for receiving a ball, the expandable mesh web being attached to the frame member and having a plurality of openings provided therein and further having at least two elements integrally woven with and formed of the same material as the web such that the two elements are fixed to the web, wherein the two elements extend substantially longitudinally along the length of the web, and define a ball channel.

2. A head for a lacrosse stick as recited in claim 1, wherein each of the elements of the expandable mesh web has a thickness greater than the thickness of the remaining portions of the expandable mesh web.

3. A head for a lacrosse stick as recited in claim 1, wherein the elements extend continuously and substantially parallel to the side walls of the frame member.

4. A head for a lacrosse stick as recited in claim 1, wherein the elements extend intermittently and substantially parallel to the side walls of the frame member.

5. A head for a lacrosse stick as recited in claim 1, wherein the ball channel is provided approximate a middle portion of the expandable mesh web.

6. A head for a lacrosse stick as recited in claim 1, wherein the expandable mesh web and the elements comprise a synthetic material.

7. A head for a lacrosse stick as recited in claim 6, wherein the synthetic material comprises nylon.

8. A head for a lacrosse stick as recited in claim 1, wherein the thickness of each of the elements ranges from 1/16 inch to 1/4 inch.

9. A head for a lacrosse stick as recited in claim 1, wherein the width of each of the elements ranges from 1/8 inch to 1/2 inch.

10. A head for a lacrosse stick as recited in claim 1, wherein the at least two elements comprises at least two outer elements and at least two inner elements, the at least two outer elements being closer to the side walls of the frame member than the at least two inner elements.

11. An expandable mesh web for use with a lacrosse stick head comprising a frame member having first and second side walls, each of the side walls having a proximal end and a distal end, the frame member further having a scoop extending between the distal ends of the side walls, and a stop extending between the proximal ends of the side walls, the expandable mesh web comprising:

a portion attached to the frame member; and at least two elements integrally woven with and formed of the same material as the web such that the two elements are fixed to the web, wherein the two elements extend substantially longitudinally along the length of the web, and define a ball channel.

12. An expandable mesh web as recited in claim 11, wherein each of the elements has a thickness greater than the thickness of the remaining portions of the expandable mesh web.

13. An expandable mesh web as recited in claim 11, wherein the elements extend continuously and substantially parallel to the side walls of the frame member.

14. An expandable mesh web as recited in claim 11, wherein the elements extend intermittently and substantially parallel to the side walls of the frame member.

15. An expandable mesh web as recited in claim 11, wherein the elements are provided approximate a middle portion of the expandable mesh web.

16. An expandable mesh web as recited in claim 11, wherein the expandable mesh web and the elements comprise a synthetic material.

17. An expandable mesh web as recited in claim 16, wherein the synthetic material comprises nylon.

18. An expandable mesh web as recited in claim 11, wherein the thickness of each of the elements ranges from 1/16 inch to 1/4 inch.

19. An expandable mesh web as recited in claim 11, wherein the width of each of the elements ranges from 1/8 inch to 1/2 inch.

20. An expandable mesh web as recited in claim 11, wherein the at least two elements comprises at least two outer elements and at least two inner elements, the at least two outer elements being closer to the side walls of the frame member than the at least two inner elements.

* * * * *